US005356045A

United States Patent [19]

Parks et al.

[11] Patent Number: 5,356,045

[45] Date of Patent: Oct. 18, 1994

[54] FLUID DISPENSING APPARATUS HAVING TAMPER EVIDENT ASSEMBLIES

[75] Inventors: Richard D. Parks, Horton; Ernest F. Kulikowski, Albion; Paul J. E. Fournier, Jackson; Douglas R. Fortman, Canton; John D. Boland, Jackson, all of Mich.

[73] Assignee: Aeroquip Corporation, Maumee, Ohio

[21] Appl. No.: 181,658

[22] Filed: Jan. 14, 1994

Related U.S. Application Data

[63] Continuation of Ser. No. 840,507, Feb. 24, 1992, abandoned.

[51] Int. Cl.[5] ..... B67D 5/33

[52] U.S. Cl. ..... 222/153; 222/482; 222/543; 222/397; 222/400.7; 222/562; 220/214; 220/324

[58] Field of Search ..... 358/156, 162; 137/383, 137/800; 220/214, 324; 222/153, 481.5, 543, 397, 400.7, 464, 562, 482; 285/914

[56] References Cited

U.S. PATENT DOCUMENTS

| | | | |
|---|---|---|---|
| 1,885,678 | 11/1932 | Boyer | 222/400.7 |
| 1,918,049 | 7/1933 | Moske | 222/153 |
| 2,023,837 | 12/1935 | Heins | 222/153 |
| 2,076,893 | 4/1937 | Johnson | 222/153 |
| 2,196,997 | 4/1940 | Larson | 222/400.7 |
| 2,272,442 | 2/1942 | Tamminga | 222/153 |
| 3,090,530 | 5/1963 | Peeps | 222/400.7 |
| 3,605,773 | 9/1971 | Schmidt et al. | 137/383 |
| 4,280,723 | 7/1981 | Moldestad | 285/914 |
| 4,347,946 | 9/1982 | Nichols | 222/543 |
| 4,741,457 | 5/1988 | Joseph | 220/466 |
| 4,899,781 | 2/1990 | Monroe | 137/382 |
| 5,067,530 | 11/1991 | Short, III | 141/98 |
| 5,179,976 | 1/1993 | Boland et al. | 137/614.06 |

FOREIGN PATENT DOCUMENTS

| | | | |
|---|---|---|---|
| 21929 | 8/1929 | Australia | 222/153 |
| 0297372 | 1/1989 | European Pat. Off. | B67D 5/02 |
| 0341533 | 11/1989 | European Pat. Off. | 222/400.7 |
| 1187435 | 2/1965 | Fed. Rep. of Germany | 285/914 |
| 0275992 | 11/1989 | Japan | 285/914 |
| 2058264 | 4/1981 | United Kingdom | 222/400.7 |
| 2196682 | 5/1988 | United Kingdom | B65D 25/38 |

*Primary Examiner*—Andres Kashnikow
*Assistant Examiner*—Kenneth Bomberg
*Attorney, Agent, or Firm*—Emch, Schaffer, Schaub & Porcello Co.

[57] ABSTRACT

A fluid dispensing apparatus is disclosed. The apparatus includes a fluid container defining a fluid cavity. A manifold assembly is mounted over a container bunghole. A tube assembly including a fill tube extends into the fluid cavity. Keyed couplings are mounted on the manifold assembly. One of the couplings is in communication with the fill tube and another coupling is in communication with the cavity. A pressure relief valve is mounted adjacent the manifold assembly. Tamper evident assemblies are provided on the manifold assembly for determining if the fluid container has been opened.

12 Claims, 5 Drawing Sheets

FLUID DISPENSING APPARATUS HAVING TAMPER EVIDENT ASSEMBLIES

This is a continuation of copending application Ser. No. 07/840,507 filed on February 24, 1992 now abandoned.

BACKGROUND OF THE INVENTION

The present invention relates to a fluid dispensing apparatus for storing, transporting and dispensing chemicals. More specifically, the present invention is directed to a fluid dispensing system for handling high purity chemicals.

Types of high purity chemicals include high purity solvents such as acetone, benzene, carbon tetrachloride, ether, methanol and trifluorothane.

In transporting and storing chemicals such as high purity solvents, it is important that the purity be maintained. It is also important that the solvents such as trifluorothane are not discharged into the atmosphere.

SUMMARY OF THE INVENTION

The present invention is directed to a fluid dispensing apparatus which maintains chemicals in their desired state and also retards the accidental discharge of such chemicals into the atmosphere, In addition, the improved fluid dispensing apparatus, according to the present invention, includes a tamper-evident means which indicates if the container has been opened.

The fluid dispensing apparatus, according to the present invention, includes a fluid container which defines a fluid cavity and has a bunghole. A manifold assembly is mounted over the bunghole and supports a tube assembly. The tube assembly includes a fill tube which extends downwardly into the cavity of the fluid container.

Couplings, preferably keyed couplings, are provided. The coupling parts are mounted on the manifold assembly. One of the coupling parts is in fluid communication with the fill tube and another coupling part is in communication with the container cavity. A pressure relief valve is mounted adjacent the manifold assembly and is also in communication with the fluid cavity of the container. Tamper-evident means are provided on the manifold assembly for determining if the fluid container has been opened.

DESCRIPTION OF THE PREFERRED EMBODIMENT

Figure 1:
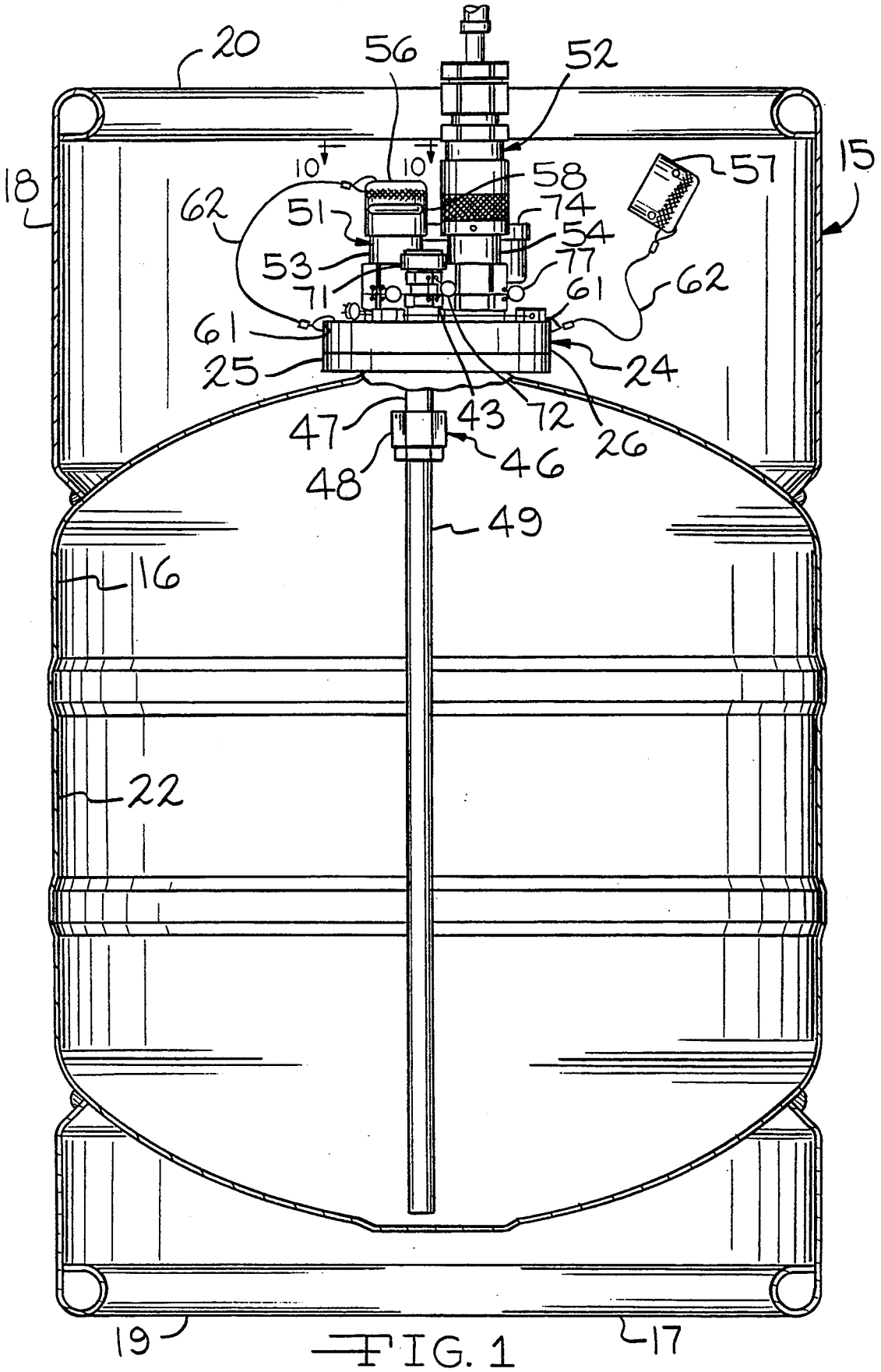
FIG. 1 is a partial cross sectional view of a fluid dispensing apparatus, according to the present invention.
Figure 2:
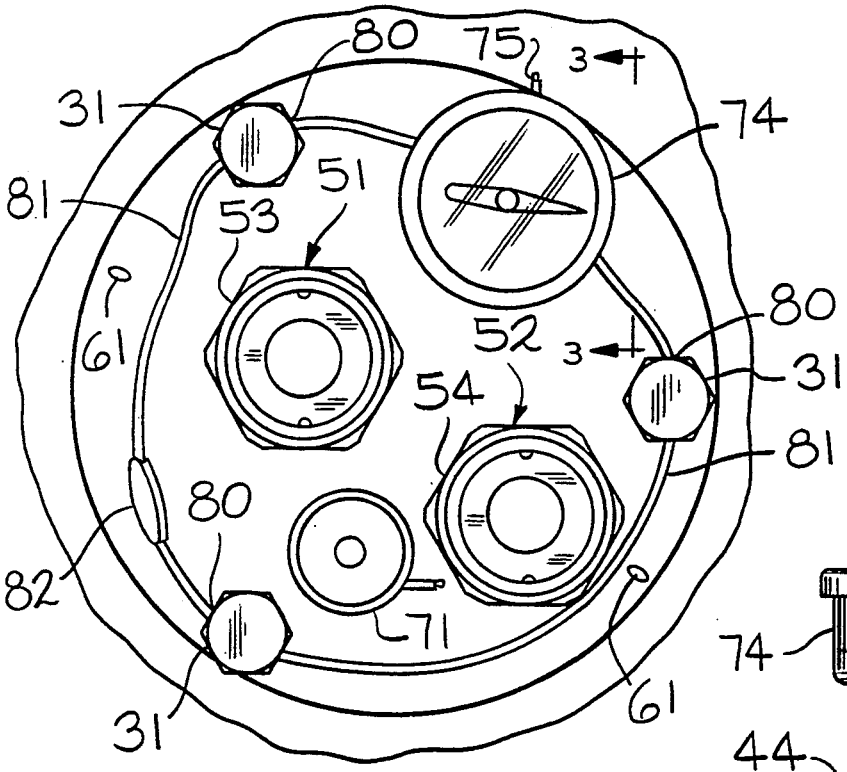
FIG. 2 is a fragmentary top view of the fluid dispensing apparatus shown in FIG. 1.

A fluid dispensing apparatus, according to the present invention, is generally indicated by the reference number 15 in FIG. 1. The fluid dispensing apparatus 15 includes a fluid container 16 which is preferably constructed from a stainless steel. A base 17 is welded to the container 16. A collar 18 is welded to the other end of the container 16 in opposed relationship to the base 17. The base 17 and the collar 18 both include rolled rings 19 and 20.

Figure 4:
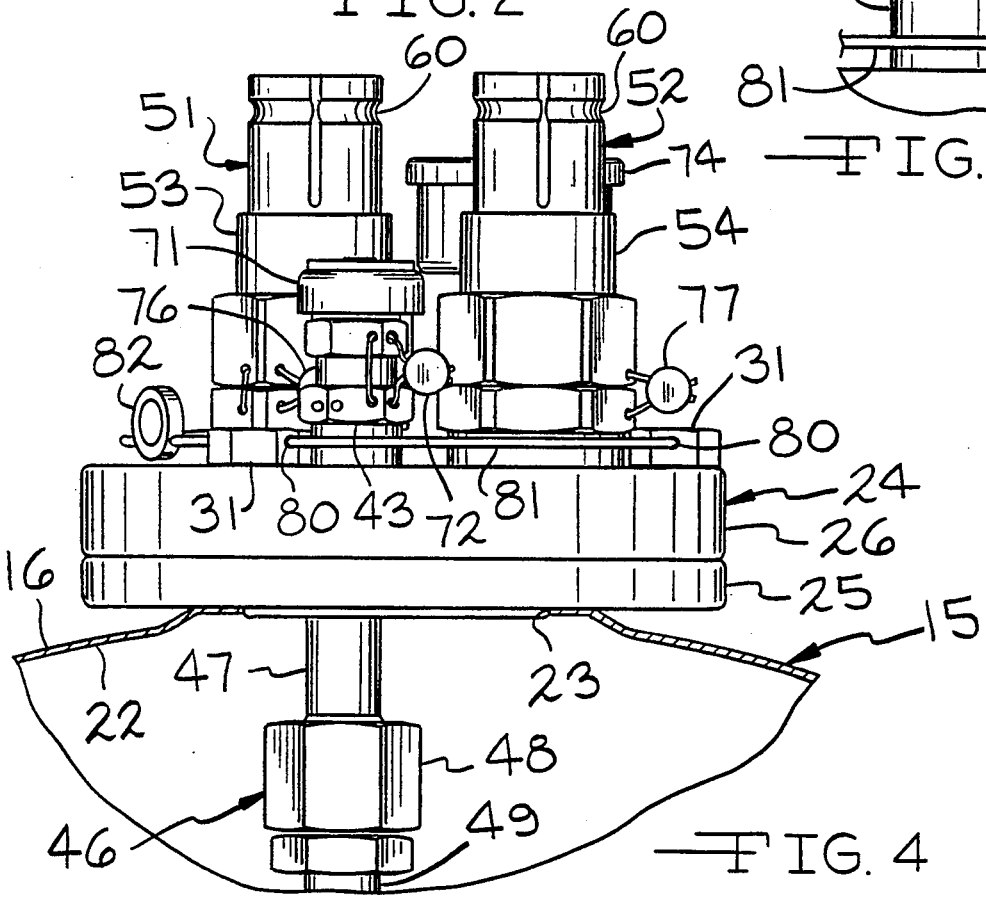
FIG. 4 is an elevational view, partially in section, showing the manifold assembly and the coupling parts.
Figure 9:
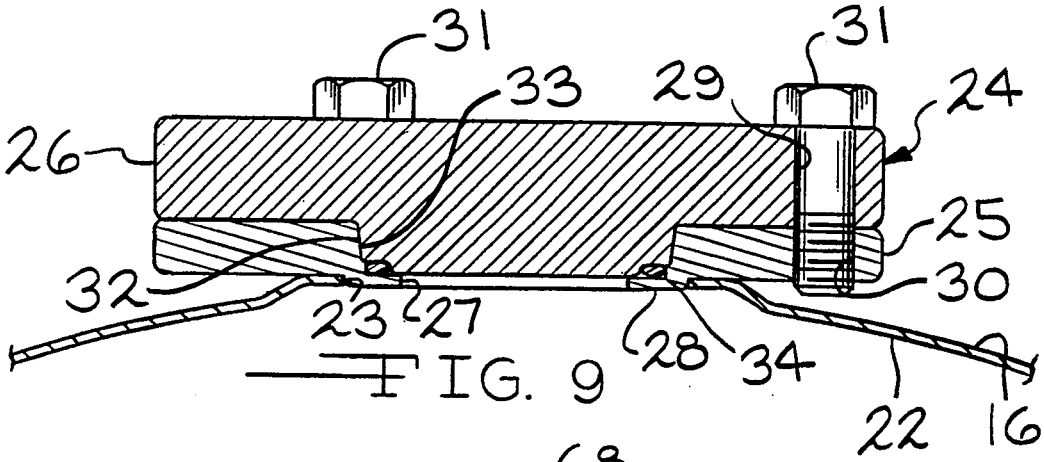
FIG. 9 is a cross sectional view of the manifold assembly showing the manifold flange mounted on the bung flange.

The fluid dispensing apparatus 15 defines a fluid cavity 22 and also defines a bunghole 23 adjacent its upper end (see FIG. 4). A manifold assembly 24 is mounted adjacent the bunghole 23. The manifold assembly 24 includes a bunghole flange 25 and a manifold flange 26. The bunghole flange 25 defines a central opening 27 (see FIG. 9) which is positioned adjacent the bunghole 23. As shown in FIG. 9, in the present embodiment, a circular lip 28 is defined by the bunghole flange 25 and is received in the bunghole 23. The bunghole flange 25 is preferably constructed of stainless steel and is welded or otherwise attached to the fluid container 16.

Figure 5:
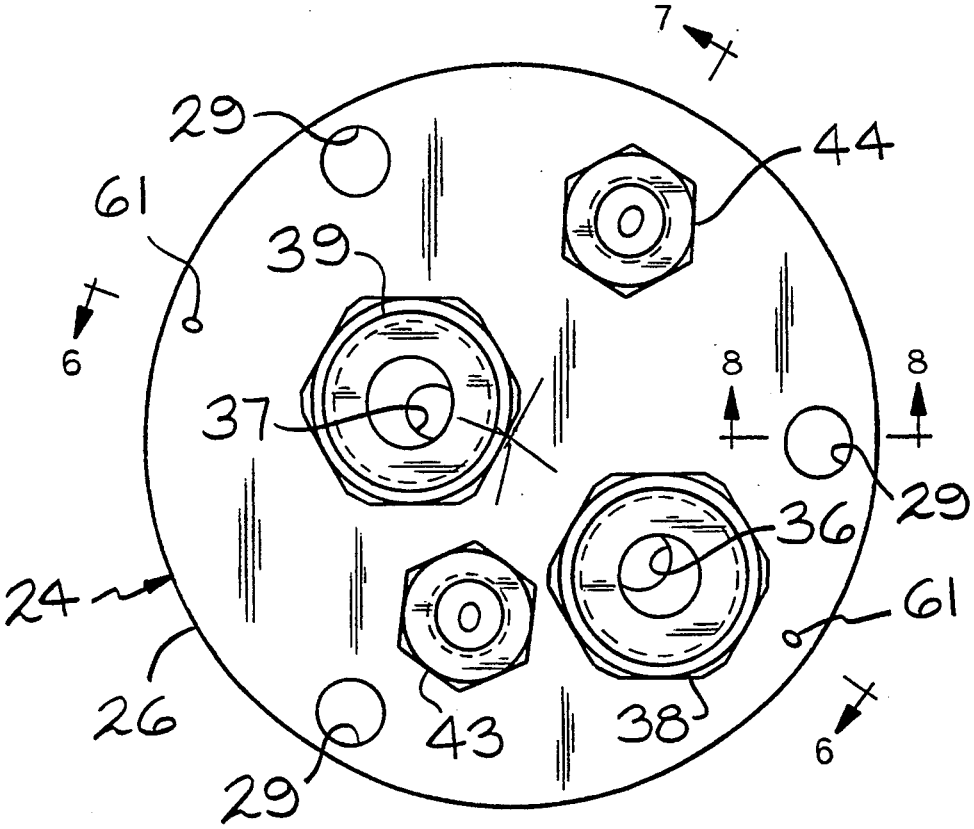
FIG. 5 is a top plan view of the manifold flange.
Figure 7:
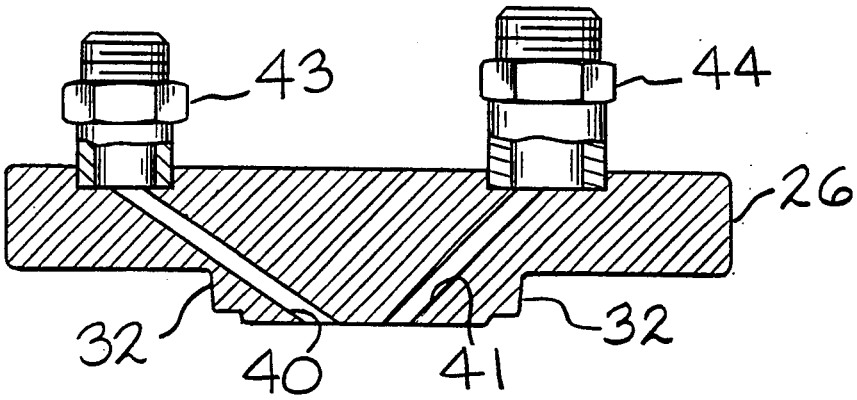
FIG. 7 is a cross sectional view taken along the line 7—7 of FIG. 5.
Figure 8:
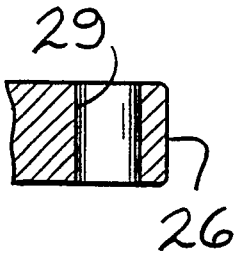
FIG. 8 is a fragmentary, cross sectional view taken along the line 8—8 of FIG. 5.

Referring to FIG. 5, the manifold flange 26 defines a plurality of bolt holes 29 which are aligned with a corresponding number of threaded holes 30 provided in the bunghole flange 25. In the present embodiment, three bolt holes 29 and three threaded holes 30 are provided. Bolts 31 extend through the bolt holes 29 and are threadably received in the threaded holes 30. Referring to FIGS. 7 and 9, the manifold flange 26 includes a depending central portion 32 which is received by a center recess 33 defined by the bunghole flange 25. Preferably, a "TEFLON" material (tetrafluoroethylene polymer) o-ring seal 34 is positioned between the bunghole flange 25 and the manifold flange 26, adjacent the central opening 27 prior to tightening the bolts 31 to complete the overall manifold assembly 24.

The manifold assembly 24, including the bunghole flange 25 and the manifold flange 26 are also preferably constructed from a stainless steel.

Figure 6:
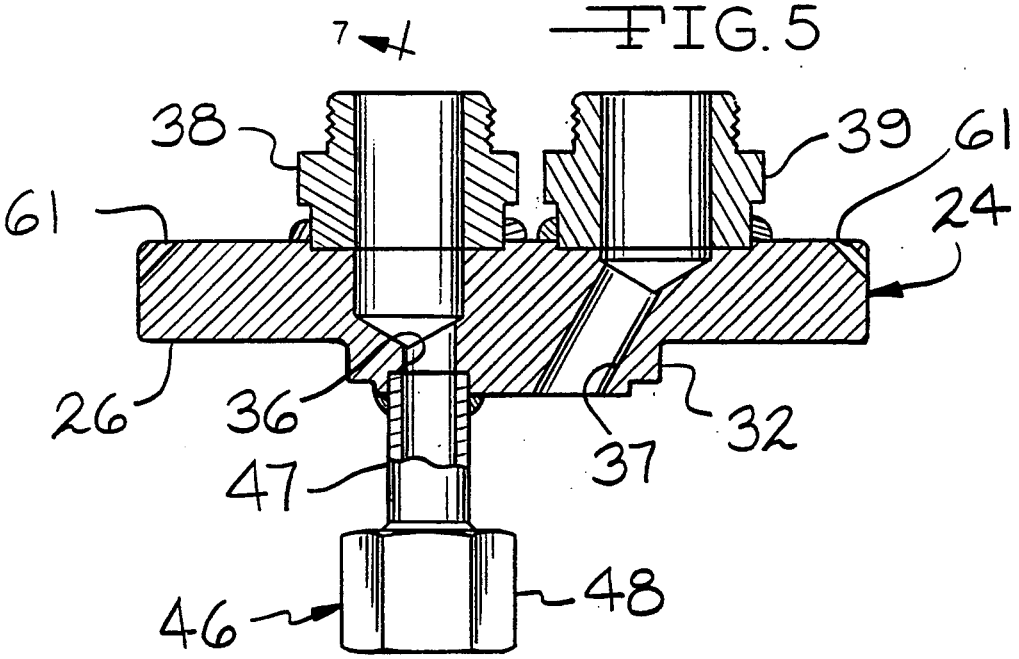
FIG. 6 is a cross sectional view taken along the line 6—6 of FIG. 5.

Referring to FIGS. 5, 6 and 7, the manifold flange 26 defines passageways 36 and 37 extending therethrough. Nipples 38 and 39 are welded to the manifold flange 26 and are in communication with the passageways 36 and 37 which terminate at the bottom of the central portion 32 adjacent the bunghole 23.

Smaller passageways 40 and 41 (see FIG. 7) are also defined by the manifold flange 26 and also terminate at the bottom of the central portion 32 adjacent the bunghole 23. Nipples 43 and 44 are attached to the manifold flange 26 and are in communication with the passageways 40 and 41, respectively.

Referring to FIGS. 1 and 6, a fill tube assembly 46 is attached to the bottom of the manifold flange 26 and extends downwardly into the fluid cavity 22 of the container 16. The fill tube assembly 46 includes a conduit 47 which is welded to the manifold flange 26 and in communication with the passageway 36. A fitting 48 is mounted at the lower end of the conduit 47 and a fill tube 49 is removably attached to the fitting 48. Again, all of the components are preferably constructed of a stainless steel. The fill tube 49 is furnished in various lengths. The container 16 is constructed of various sizes, which necessitates filling tubes 49 of various lengths. For example, the fluid container 16 may be constructed in 20 liter, 57 liter and 255 liter sizes.

Couplings 51 and 52 have coupling parts 53 and 54 which are connected to the nipples 38 and 39, respectively. The couplings 51 and 52 are preferably keyed couplings which prevent the filling or removal of erroneous chemicals to or from the container 16. The keyed couplings 51 and 52 are preferably of the type disclosed in the assignee's U.S. Pat. No. 5,179,976. The disclosure of that patent is incorporated herein by reference.

The coupling 51 is in communication with the fluid cavity 16 by way of the passageway 36 and the fill tube assembly 46. Similarly, the coupling 52 is in communication with the fluid cavity 22 by way of the passageway 37.

The coupling 51 is utilized to fill and discharge chemicals to and from the fluid cavity 16 of the fluid dispensing apparatus 15. The coupling 52 is utilized to pressurize the fluid cavity 16. The pressurizing gas or fluid is an inert gas such as nitrogen or argon. The operating pressures of the inert gas vary but are normally in the range of 5 psi/g to 100 psi/g.

When the coupling parts 53 and 54 are in the condition, shown in FIG. 4, caps 56 and 57 are positioned on such coupling parts. The caps 56 and 57 include opposed slots 58 in their side walls which are aligned with peripheral grooves 60 defined by the coupling parts 53 and 54.

Figure 10:
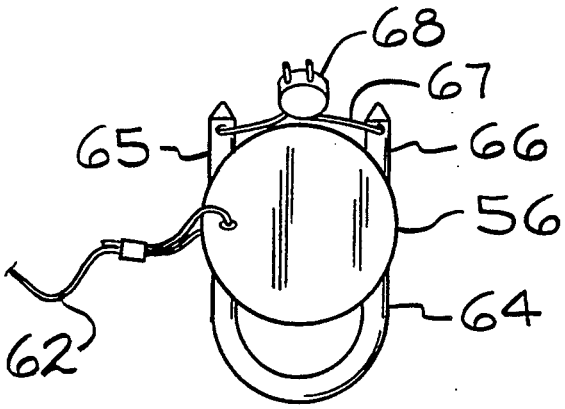
FIG. 10 a top plan view showing a tamper-evident means for use with a connector.

Referring to FIG. 5, the periphery of the manifold flange 26 defines a pair of opposed openings or cable anchors 61. The caps 56 and 57 are removably positioned over the coupling parts 53 and 54. Cables 62 extend from the cable anchors 61 and are attached to the caps 56 and 57. The caps 56 and 57 are positioned over the coupling parts 53 and 54 such that the opposed slots 58 are aligned with the peripheral grooves 60. A lock member 64 is then inserted (see FIG. 10). The lock member 64 is generally u-shaped and has legs 65 and 66 which extend into the aligned slots 58 and grooves 60. A lock wire 67 having a seal 68 extends between openings provided in the distal ends the legs 65 and 66 of the lock member 64. This provides a tamper-evident means, whereby, if the caps 56 and 57 are removed from the coupling parts 53 and 54, such tampering is visually evident.

A pressure relief valve 71 is mounted on the nipple 43 and is in communication with the fluid cavity 22. The pressure relief valve 43 also includes tamper-evident means. Referring to FIG. 4, a lock wire and seal assembly 72 is interconnected between the nipple 43 and the pressure relief valve 71.

Figure 3:
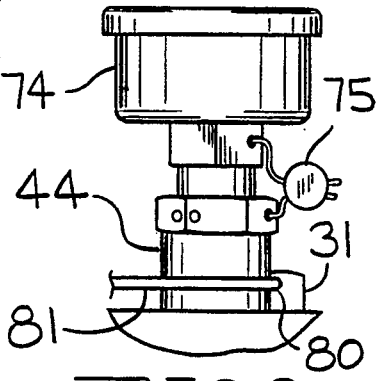
FIG. 3 is an elevational view of the pressure gauge.

In the preferred embodiment, a pressure indicator assembly 74 is mounted on the nipple 44. Tamper-evident means, more specifically a lock wire and seal assembly 75, extend between the pressure indicator assembly 74 and the nipple 44 (see FIG. 3). Referring to FIG. 4, lock wire and seal assemblies 76 and 77 are also provided between the nipples 38 and 39 and the coupling parts 53 and 54, respectively.

The heads of the each of the bolts 31 define openings or passageways 80 which receive a lock wire 81. The ends of the lock wire 81 terminate at a seal 82. The lock wire 81 and the seal 82 operating with the bolt passageway 80 provide an additional tamper evident means to make apparent the opening of the components of the fluid dispensing apparatus 50. The lock wire 81 must be severed to unscrew the bolts 80.

Preferably all of the components of the fluid dispensing apparatus 15, which are in possible contact with any chemicals held by the fluid container 16 are constructed of a stainless steel or another noncorrosive and noncontaminating material.

Figure 11:
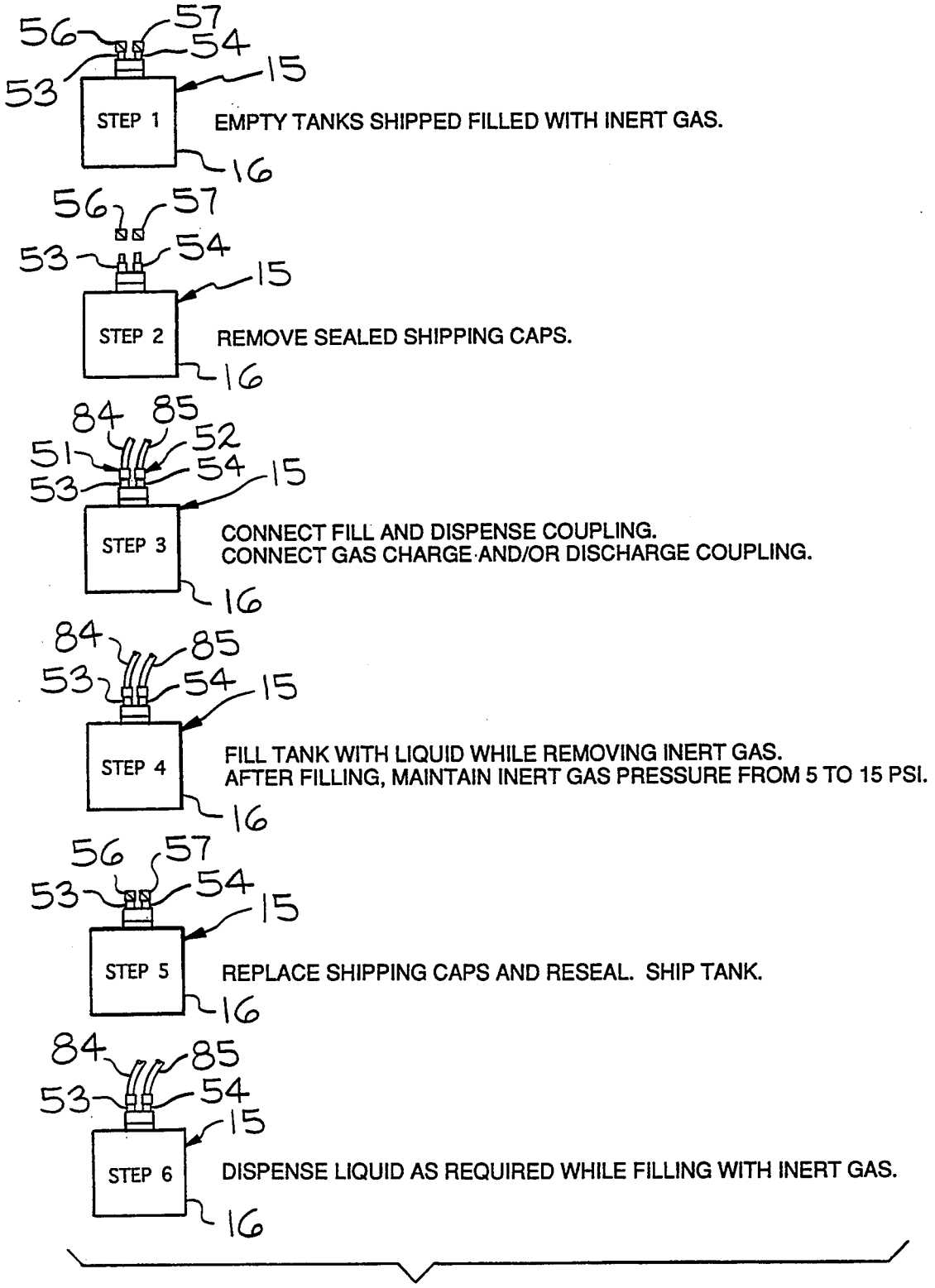
FIG. 11 is a diagrammatic view showing the method steps when utilizing a fluid dispensing apparatus, according to the present invention.

Referring to FIG. 11, the use of a fluid dispensing apparatus 15, according to the present invention, is diagrammatically illustrated. Prior to step 1, the new fluid dispensing apparatus 15, according to the present invention, is cleaned in a conventional manner. The fluid dispensing apparatus 15 is totally assembled as shown in step 1. Immediately after the cleaning and assembling process, the empty fluid container 16 is filled with an inert gas, such as nitrogen. The following steps may be performed on site prior to shipment or performed by a purchaser. At step 2, the caps 56 and 57 are removed from the coupling parts 53 and 54. At step 3, the couplings 51 and 52 place the fluid container 16 into fluid communication with conduits 84 and 85. The conduit 84 during initial charging is connected to a source of a chemical, such as trifluorothane. The coupling 85 is connected to a receiving container for the inert gas, such as nitrogen.

At step 4, the fluid container 16 is filled with a fluid received from the conduit 84 while at the same time removing inert gas through the conduit 85. After filling, the inert gas pressure is preferably maintained at between 5 and 15 psi/g, however, the range of inert gas pressure may vary from approximately 5 psi/g to 100 psi/g.

At step 5, the caps 56 and 57 are repositioned on the coupling parts 53 and 54 and all of the tamper evident means are checked or activated. The fluid dispensing apparatus 15 is now in a storage mode where it remains until utilization. In many cases the fluid dispensing apparatus 15 is shipped to an ultimate user.

When it is desired to utilize the chemical within the fluid container 16, the caps 53 and 54 are again removed and the container parts 53 and 54 are connected to additional conduits 84 and 85. In this situation, the conduit 84 is dispensing chemical from gas to the fluid container 16.

Prior to use by the ultimate user, all of the tamper-evident means are visually check to ensure that the seals have not been broken and the apparatus 15 opened.

Many modification may be made to the above-identified preferred embodiment and method without departing from the scope of the invention or from the following claims.

We claim:

1. Fluid dispensing apparatus comprising, in combination, a stainless steel fluid container defining a fluid cavity and having a bunghole at its upper end, a manifold assembly mounted at such upper end adjacent such bunghole, a fill tube assembly mounted by said manifold assembly, said fill tube assembly including a fill tube extending downwardly into such cavity of said fluid container, said manifold assembly including a bunghole flange surrounding such bunghole and attached to said fluid container and a manifold flange connected to said bunghole flange by a plurality of bolts, a pair of coupling parts mounted on said manifold flange, one of said coupling parts being in fluid communication with said fill tube and said other one of said coupling parts being in communication with such fluid cavity, caps removably positioned over said coupling parts, each of said coupling parts and each of said caps includes corresponding alignment means for receiving a lock member when said caps are positioned on said coupling parts, a pressure relief valve mounted on said manifold assembly and tamper evident means on said manifold assembly for determining if said fluid container has been opened, said tamper evident means including a first lock wire assembly connected to said lock member and a second lock wire assembly connected to said plurality of bolts.

2. Fluid dispensing apparatus, according to claim 1, including a base having a rolled ring attached to said fluid container.

3. Fluid dispensing apparatus, according to claim 2, including a collar having a rolled ring attached to said fluid container in opposed relationship to said base.

4. Fluid dispensing apparatus, according to claim 1, wherein said fill tube assembly includes a conduit fixedly attached to said manifold assembly and said fill tube removably attached to said conduit by a fitting.

5. Fluid dispensing apparatus, according to claim 1, wherein each of said alignment means includes a peripheral groove on each of said coupling parts and each of said caps includes opposed slots for alignment with said groove, said tamper evident means including said lock member having legs insertable into said opposed slots and said groove and a lock wire extending between said legs, whereby said lock wire must be severed to remove said lock member.

6. Fluid dispensing apparatus, according to claim 1, including a pressure indicator assembly having tamper evident means mounted on said manifold assembly.

7. Fluid dispensing apparatus comprising, in combination, a fluid container defining a fluid cavity and having a bunghole, a manifold assembly mounted adjacent such bunghole, a fill tube assembly mounted by said manifold assembly, said fill tube assembly including a fill tube extending downwardly into such cavity of said fluid container, at least two coupling parts mounted on said manifold assembly, one of said coupling parts being in fluid communication with said fill tube assembly, another one of said coupling parts being in fluid communication with such cavity of said fluid container, a pressure relief valve mounted adjacent said manifold assembly, said pressure relief valve being in fluid communication with such fluid cavity of said fluid container, tamper evident means on said manifold assembly for determining if said fluid container has been opened and caps removably positioned over said coupling parts, wherein each of said coupling parts includes a peripheral groove and each of said caps includes opposed slots for alignment with said groove, said tamper evident means including a lock member having legs insertable into said opposed slots and said groove and a lock wire extending between said legs, whereby said lock wire must be severed to remove said lock member.

8. Fluid dispensing apparatus, according to claim 7, wherein said manifold assembly includes a bung flange separate from said container having a central opening adjacent said bunghole, said bung flange defining a plurality of threaded holes, a manifold flange mounted on said bunghole flange, said manifold flange defining a plurality of openings aligned with said threaded holes and bolts extending through said openings and engaged with said threaded holes.

9. Fluid dispensing apparatus, according to claim 8, including a seal consisting of a tetrafluoroethylene material, said seal positioned between said bunghole flange and said manifold flange adjacent said central opening of said bung flange.

10. Fluid dispensing apparatus, according to claim 8, wherein each of said bolts include laterally extending passageways, said tamper evident means includes a second lock wire extending through each of said bolt passageways, whereby said second lock wire must be severed to unscrew said bolts.

11. Fluid dispensing apparatus, according to claim 8, wherein said manifold flange includes a plurality of cable anchors, cables extending from said cable anchors to said caps.

12. Fluid dispensing apparatus, according to claim 11, wherein said cable anchors comprise cable openings defined by a periphery of said manifold flange.

* * * * *